United States Patent [19]

Miura et al.

[11] 3,998,201

[45] Dec. 21, 1976

[54] CONCRETE BREAKER

[75] Inventors: Mitsuo Miura, Tokyo; Masahiro Takigawa, Ashiya; Masao Miyaguchi, Tokyo; Hiromichi Yamada, Tokyo; Iwao Uchizaki, Tokyo; Minoru Ochiai, Tokyo; Yoshihiro Ishikawa, Nishinomiya, all of Japan

[73] Assignee: Takenaka Komuten Company, Ltd., Japan

[22] Filed: Nov. 23, 1973

[21] Appl. No.: 418,361

[30] Foreign Application Priority Data

| | | |
|---|---|---|
| Nov. 29, 1972 | Japan | 47-120094 |
| Nov. 30, 1972 | Japan | 47-120485 |
| Sept. 8, 1973 | Japan | 48-101567 |

[52] U.S. Cl. ..... 125/23 C; 100/231; 125/23 R; 225/103

[51] Int. Cl.[2] ..... B02C 1/00; B28D 1/32

[58] Field of Search ..... 241/266; 125/23 R, 23 C; 100/231; 225/93, 94, 103

[56] References Cited

UNITED STATES PATENTS

| | | | |
|---|---|---|---|
| 2,657,681 | 11/1953 | Gatzke | 125/23 R |
| 2,768,620 | 10/1956 | Jenkins et al. | 225/103 X |
| 3,392,719 | 7/1968 | Clanton et al. | 125/23 R |
| 3,817,236 | 6/1974 | Schlough | 125/23 C |

FOREIGN PATENTS OR APPLICATIONS

| | | | |
|---|---|---|---|
| 229,397 | 3/1969 | U.S.S.R. | 175/73 |
| 234,301 | 5/1969 | U.S.S.R. | 175/73 |

*Primary Examiner*—Roy Lake
*Assistant Examiner*—E. F. Desmond
*Attorney, Agent, or Firm*—Fidelman, Wolffe & Waldron

[57] ABSTRACT

A concrete breaker, in which in breaking a concrete structure, the inclination of the main chisel is maintained within a desired angle by a limit switch to prevent the chisel receiving bed and the ram from being damaged at least two mini-chisels disposed opposite the main chisel are slidably arranged and driving means for these chisels are encased in a machine frame provided with machine beds so that the machine body may be formed smaller and lighter in weight.

9 Claims, 10 Drawing Figures

CONCRETE BREAKER

This invention relates to improvements in machines for breaking concrete structures using a static compression load, more particularly to an improved concrete breaker which can break such a structure effectively and efficiently with the least strength.

When dismembering superannuated reinforced concrete buildings, a concrete breaker incorporating a jack mechanism therein has hitherto been utilized to break slabs, beams, pillars, etc. in such buildings without making noises and vibrations.

A concrete breaker of this type has a chisel mounted at the extreme end of the ram in the jack and breaks the concrete by way of a static compressive force of the jack.

The concrete is, however, very hard and has a substantial strength against the compressive force. In case the concrete is reinforced by iron or the like, it is extremely difficult to break it.

In usual cases, it is not so difficult a design problem to strengthen the output of the oil pressure jack to the magnitude required to break the concrete. However, when the jack output exceeds 200 tons, there arises a problem regarding the strength of the machine frame for effectively utilizing said output as a breaking force acting on the concrete. In practice, it is considered that it may not be impossible but difficult to design and manufacture a breaker having a jack output in excess of 200 tons.

In view of present technical conditions, the present inventors have studied with an aim of developing a breaker having a maximum breaking ability within a jack output range of 200 tons, and have developed an apparatus for dismembering a building structure without making any vibrations and noises in consideration of densed architectural conditions in cities. This apparatus includes machine beds having a main chisel held at one side to vary the penetrating direction thereof and a mini-chisel held at the side opposite thereto, and a substantially C shaped box type machine frame being formed thereon.

However, when the penetrating direction of the main chisel is bent at an angle in excess of a certain degree, an unreasonable reactive force is applied to said chisel receiving bed and at the same time a reactive force is applied to the ram and jack itself to induce the cause of the trouble. On the other hand, since only one mini-chisel is provided opposite the main chisel, the force for clamping the concrete is not sufficient, and the direction of crushing thereof tends to be displaced from the center moving toward the periphery. The main chisel and mini-chisels may be forced outside the machine frame and therefore they may contact with other structures by accident during the breaking operation to cause damage to machinery and instruments. Thus, the disadvantages of the prior art apparatus are apparent.

The present invention provides an extremely effective and greatly promising apparatus, which as previously described, can provide a stable clamping of a load to be broken, ideally break said load substantially along the center line thereof, dismember it without making noises, vibrations, or dust and in a highly safe manner, offer good workability and economic operation. The apparatus of the present invention can freely dismember slabs, pillars, beams, walls, etc. and requires a single unit regardless of the construction of the building, and requires little skill to operate, thus permitting the use of less operators and saving manpower. The apparatus is compact and thus easy to move, install and maintain.

The invention relates to improvements in concrete breakers, more particularly to improvement in the characteristic of breaking and has as its object to provide a breaker in which the inclination of the main chisel is maintained within a desired angle by a limit switch to prevent the chisel receiving bed and the ram from being damaged at least two mini-chisels disposed opposite the main chisel are slidably movably arranged and driving means for these chisels are encased in a machine frame provided with machine beds so that the characteristic of the breaking may be promoted and the machine body may be formed smaller and lighter in weight.

Other objects or features and advantages of the invention will become apparent from the specification and appended claims with reference to embodiments illustrated in the accompanying drawings.

In the drawings:

FIG. 1 is a front view showing an embodiment of a breaker in accordance with the present invention;

FIG. 2 schematically illustrates a main chisel;

This invention is proposed to eliminate various disadvantages noted above and will now be fully described in conjunction with the drawings. Like reference characters designate like or corresponding parts throughout.

Figure 1:
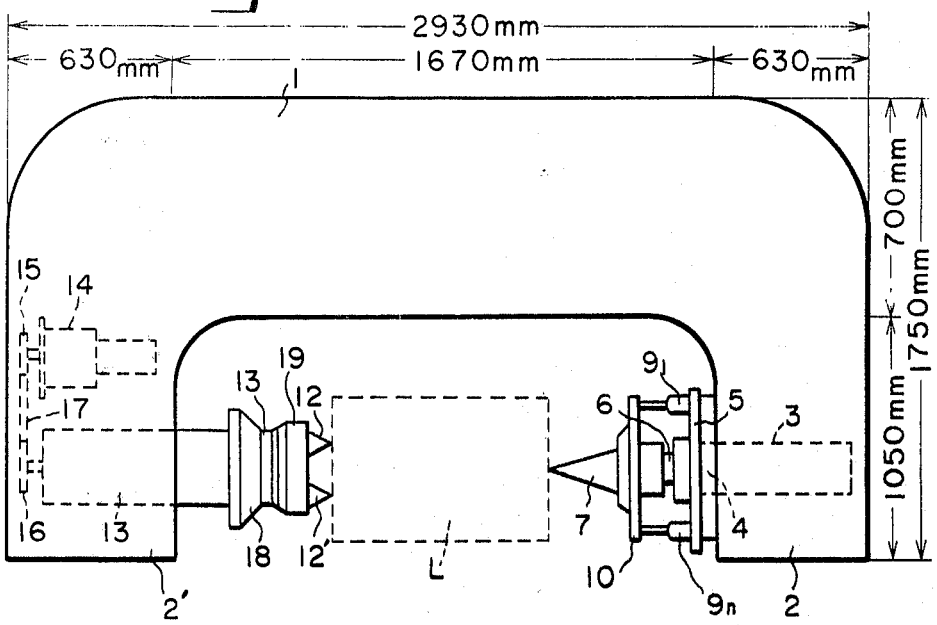
Figure 3:
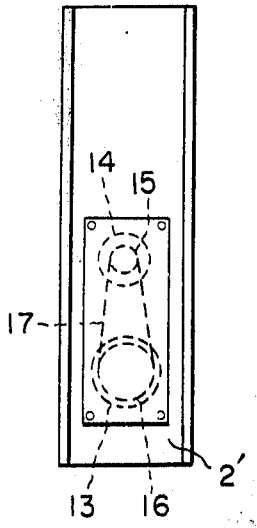
FIG. 3 is a side view as seen from left of FIG. 1.

In FIG. 1, there is shown a machine frame indicated as at 1, having machine beds 2, 2' welded at its opposite ends and formed to be a box-like shape made of a thick steel plate durable against the mechanical strength exerted thereupon. Reference numeral 3 designates an oil pressure main jack adapted to urge a main chisel 7. A circular chisel receiving bed 5 is threaded into the extreme end of a ram 4 on said jack 3, a spherical head 6 is formed in the mid-portion of said receiving bed 5 so as to be coupled in the form of a universal joint with a spherical seat 8 formed at the rear of the wedge-like main chisel 7, said chisel being arranged flexibly movably at a desired angle.

Figure 2:
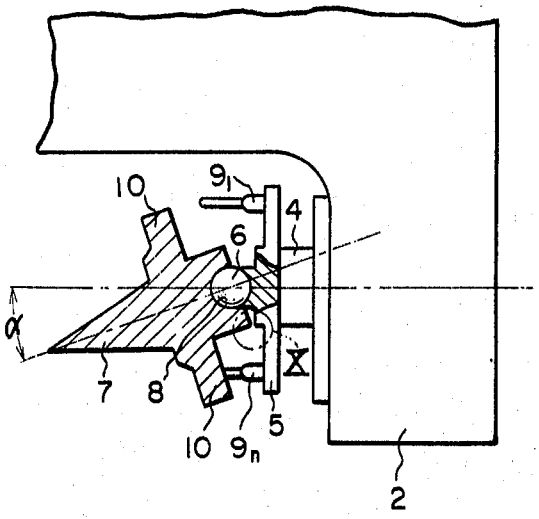
Figure 5:
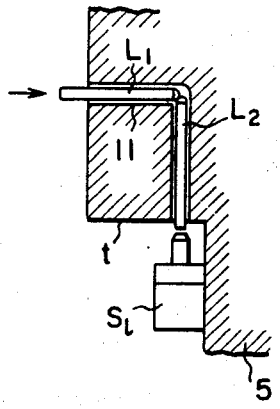
FIG. 5 is an enlarged view taken along the portion X in FIG. 2.

Reference characters $9_1, 9_2 \ldots 9_n$ designate a plurality of sub-jacks coaxially disposed in the periphery of the chisel receiving bed 5, and shift rods of said sub-jacks are actuated by driving means (not shown) to urge the rear surface of a flange 10 of said main chisel 7, causing said main chisel to be inclined at an angle of $\alpha$ in a desired direction. Then, when the direction of the main chisel 7 exceeds said angle of $\alpha$, a plurality of limit switches *Sl* mounted in the peripheral edge of a circular offset portion *t* on the side of the spherical head 6 of the chisel receiving bed 5, as shown in FIG. 5 formed by enlarging X portion of FIG. 2, are urged by means of pressing levers $L_1$, $L_2$ fitted in a guide groove 11 made at right angles as shown to completely shut off operation of the driving system provided for the main jack 3 which presses the main chisel 7 so that the inclination of the main chisel may be controlled within said three-dimensional angle $\alpha$.

Encased in the other machine bed 2′ are an oil pressure motor or a motor 14 for causing a spindle 13 of an adjusting screw for two mini-chisels 12, 12′ to be moved back and forth in an axial direction by a suitable length, a sprocket 15 thereof, a rotating sprocket 16 disposed on said spindle 13, and a chain 17 adapted to connect these sprockets as described, each of which is disposed so that they may not be exposed outside the bed 2′. When the oil pressure motor 14 is driven, the sprocket 16 is rotated and the spindle 13 is moved back and forth by a suitable length, as previously described.

A mini-chisel receiving plate 18 is snapped into the spindle 13 and a mini-chisel receiving bed 19 is secured to the extreme end of said spindle 13.

Figure 4A:
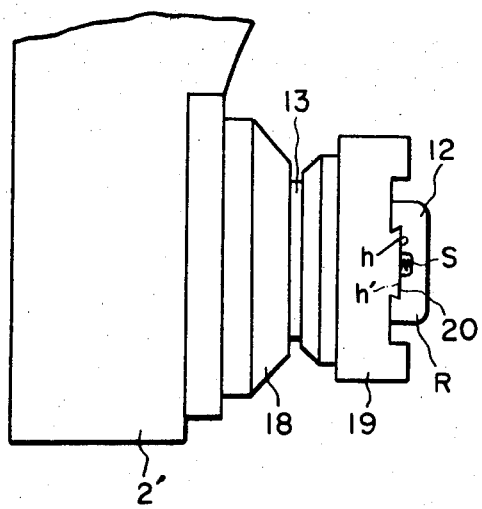
FIG. 4A and 4B are a front view and an end view, respectively, schematically illustrating mini-chisels.
Figure 4B:
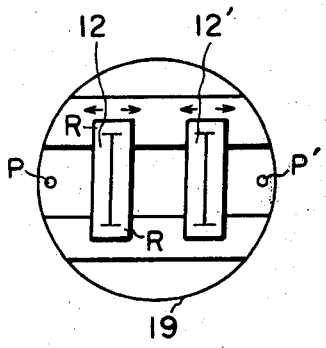

The mini-chisels 12, 12′ and the receiving bed 19 therefor will now fully be described with reference to FIG. 4A and 4B. The receiving bed 19 has its opposite surface formed with a sliding projection 20 having a somewhat larger head in the mid-portion thereof in a dovetail locking fashion. Each mini-chisel has a concave portion *h* formed at the rear surface thereof and a spring receiving hole *h′* formed in the midportion thereof, so that said mini-chisels 12, 12′ may slidably be fitted in said projection 20. A spring S having a suitable resilient strength is retained in said hole *h′* to suitably move the mini-chisels 12, 12′ by the distance desired and holding them in their position, as shown by the arrow in FIG. 4B. Reference characters P, P′ designate stoppers which limit the width of the maximum outward movement of the mini-chisels. Reference character R designates roundness of the mini-chisel shown in FIG. 4B. The size of the machine frame 1 employed in the embodiment herein is as shown in FIG. 1. The effective stroke of the main jack 3 and the spindle 13 of the ajdusting screw is approximately 300 mm, respectively.

The mode of operation together with effect of the present invention as constructed above will now be described. As shown in FIG. 1, first, mini-chisels 12, 12′ are preset in desired spaced relationship so that the instant machine moved down by means of a crane not shown is fitted in a concrete structure L, which is a load to be broken, and the main chisel 7 and mini-chisels 12, 12′ are actuated by means of driving means not shown to hold said load L therebetween.

Next, pressure of the main jack 3 is increased to initiate preparation and operation of breaking with respect to said load L, which is then firmly compressed from opposite ends thereof. Thus, cracks are produced in said load L and the main chisel 7 penetrates therein along the cracks shown in FIG. 8. Since the internal construction of said load L is irregular, the cracks tend to be produced in a direction weak in strength, and for example, if the cracks are displaced in a vertical direction by the edge of the main chisel 7, the main chisel 7 moves toward the cracks produced by the shaking of its head. When the direction of shaking of the head of the main chisel 7 exceeds a desired three-dimensional angle $\alpha$, it is placed in contact with the bottom of the flange 10 of said chisel to push the pressing lever $L_1$, and the succeeding pressing lever $L_2$ is pushed in by the extreme end thereof to actuate the limit switch S*l* so as to prevent further inclination of the chisel 7. As a result the thrust of the main jack 3 has a limited reactive component but still provides an effective breaking operation and therefore the machine frame 1 itself need absorb only a limited reactive component and may be designed to be smaller and lighter in weight, thus eliminating inconveniences encountered in the practical dismembering work and preventing the chisel receiving bed 5 from being damaged. Further, the mini-chisels 12, 12′ opposite the main chisel 7 are each slidably disposed so that the space therebetween may suitably predetermined, and therefore the load L can be supported by three points in the safest manner. Further, two mini-chisels being employed, the contact portions thereof may firmly be passed through to also act as slip stops, thus attaining the desired end without suffering from insufficient breaking due to the escape of the cracks in a peripheral direction, which results in performing a useless re-holding and positioning operation, as experienced in the prior art types.

Figure 8A:
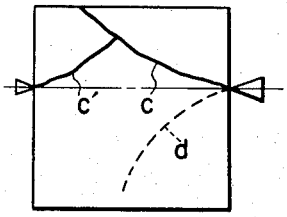
FIG. 8A and 8B schematically illustrate the condition of breaking progress of breaking loads to be broken in accordance with the prior art and the present invention, respectively.
Figure 8B:
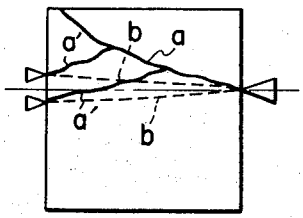

FIG. 8A and 8B illustrate examples showing how the cracks produced in the concrete structure L or load to be broken are to be oriented. In FIG. 8A, curves *c*, *c′* indicate one example which is apt to be broken by the prior art fixed type main and mini-chisels, and curve d indicates the direction of breaking in the type which does not limit the direction of the main chisel. In FIG. 8B, curves *a*, *a′* or *b* indicate the directions of the breaking using the breaker according to the present invention.

Preferably the number of limit switches S*l* are equal in number to number of the sub-jacks, however, it will be understood that a number of limit switch arrangements fall within the scope of the present invention. Also, the pressing levers $L_1$, $L_2$ for actuating the switch S*l* may be modified into one-lever type by designing the contact portions on opposite sides to be formed in a suitable shape. Still further, said switch S*l* may be mounted on the side of the main chisel instead of the position as described, and a pressing projection may be planted, in replace of the pressing lever, in a position opposite the chisel receiving bed 5. If roundness R is provided on the opposite ends of each mini-chisel (see FIG. 4B), possible damage to other parts and to the chisel itself, caused by accidental contact is reduced. Finally, the mini-chisels 12, 12′ may be incorporated three in the number when necessary. The foregoing is regarded as a mere change in design which can be accomplished by a person in the art whenever necessary.

Figure 6:
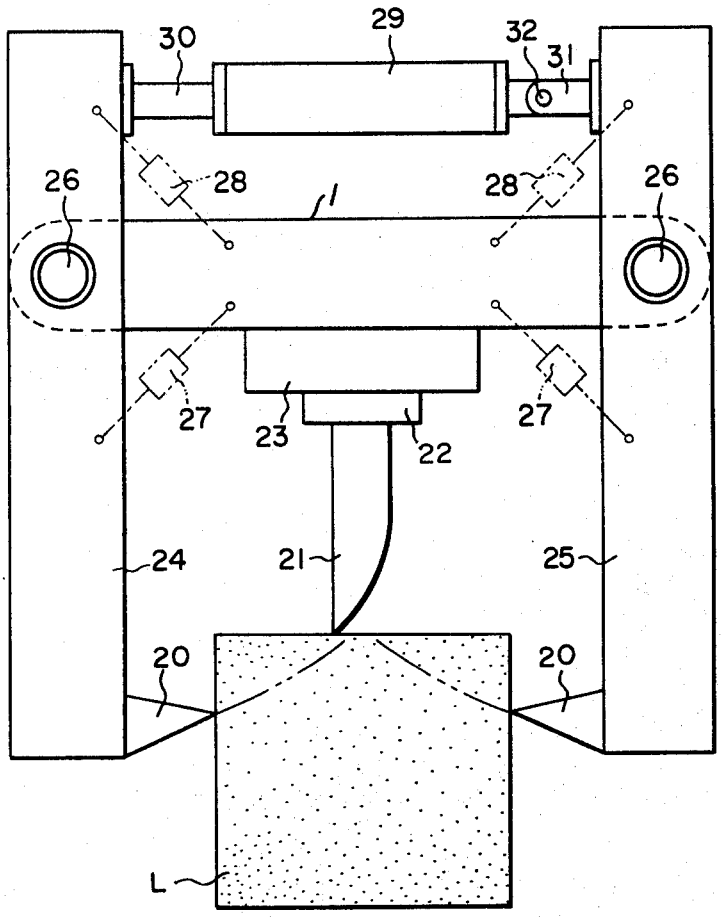
FIG. 6 is a front view showing a second embodiment of the breaker of the present invention.

FIG. 6 illustrates a second embodiment studied and developed by the instant inventors, in addition to the first embodiment of the invention shown in FIGS. 1 to 5.

In FIG. 6, reference numeral 1 designates a main frame (machine bed), 24 and 25 designate machine frames movable frame movably coupled by means of pins 26 to the ends of the main frame 1 in desired spaced relationship from the upper end thereof, 20 and 20 designate chisels opposedly mounted in the vicinity of each lower end of said movable frames 24 and 25, and a third chisel 21 is provided through a base member 22 on the lower side of the main frame 1 to further strengthen the breaking ability relative to the sliding bed 23 which is movable in both directions along the said lower side.

There are provided telescopic jacks 27, 27 in the lower part of pins 26, 26 at the joint portion between the main frame 1 and the movable frames 24, 25, and pressing jacks 28, 28 between the movable arm and the main frame above the joining pins 26. An output shaft 30 of the oil pressure jack 29 is provided on the side close to the upper end of the left movable frame 24 and the body of the oil pressure jack 29 is movably mounted by a pin 32 through a metal member 31.

From the experiment conducted by the instant inventors, it is preferable that the tensile strength acts on the main frame 1 and the bending moment principally acts on the movable frames 24, 25. Chisels 20, 20 are each equally spaced from the pins 26 and may take a radius of curvature extremely close to the direction of cracks produced in the concrete structure L which tends to break said distance.

Figure 7:
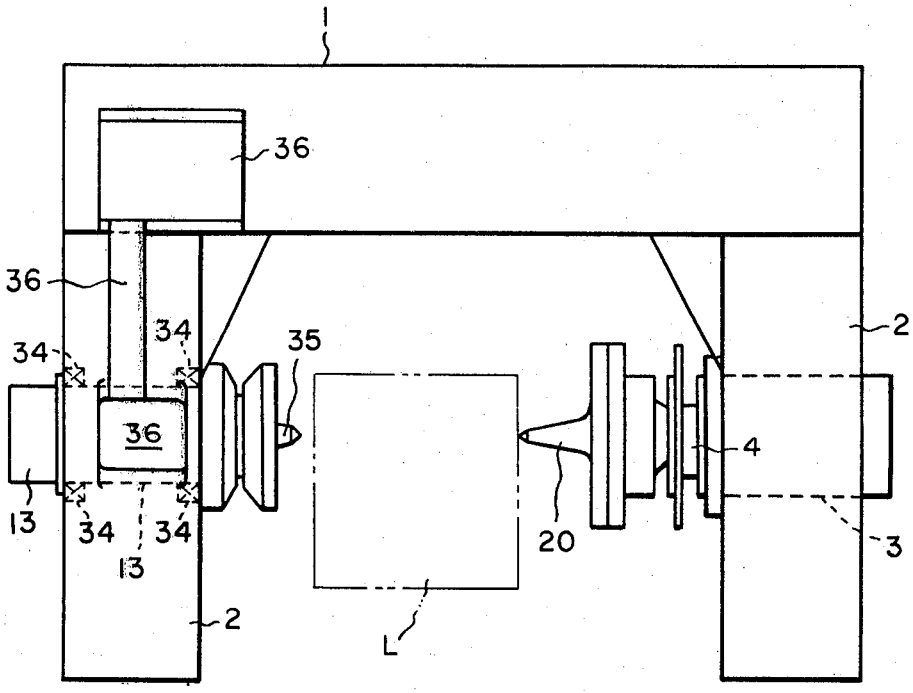
FIG. 7 is a front view showing a third embodiment showing of the breaker of the present invention.

FIG. 7 shows the third embodiment of the present invention. In this embodiment, the machine frame has sub-frames 2, 2 provided on the ends of the main frame 1 to basically form a substantially C shaped machine frame. In the drawing, reference numeral 36 indicates covers mounted to prevent the oil pressure motor attached to the machine frame, worm rack and worm meshed therewith from being damaged, 34 denotes a plain bearing for moving the spindle 13 of the adjusting screw (see FIG. 1) in an axial direction, and 35 denotes a chisel mounted on the spindle 13 and disposed opposite the chisel 20 mounted on the right sub-frame 2.

In this third embodiment, the space between the main chisel 20 and the chisel 35 positioned where the spindle 13 has completely retreated is made a maximum width, and the difference between the width of the concrete structure L having the size within the range of said maximum width and the distance between the chisels 20 and 35 is adjusted by feeding the spindle 13, thus effecting the breaking operation.

Even in this embodiment, an extremely rational function may be provided by employment of a flexible construction by incorporating socket joints between the chisel and the jack ram and between the chisel and the spindle so that the chisels may change the direction of the cracks produced in the concrete structure L.

What is claimed is:

1. A concrete breaker adapted to break a concrete structure by means of a static compressive force comprising:

a. a main frame;
b. two sub-frames disposed substantially perpendicular to said main frame on opposite ends of said main frame;
c. a jack mounted on one of said sub-frames, said jack having a ram adapted to slide linearly within said jack;
d. a first chisel receiving bed provided at the end of said jack;
e. a plurality of mini-jacks disposed on said chisel receiving bed and adapted to be pushed by said first chisel receiving bed;
f. a main chisel attached to said first chisel receiving bed by means of a socket joint in order to vary its direction of penetration;
g. an adjusting screw spindle mounted on said other subframe and movable in an axial direction;
h. a second chisel receiving bed mounted on one end of said spindle; and
i. means for moving said spindle in an axial direction provided on the other end of said spindle.

2. A concrete breaker as set forth in claim 1 further comprising:

j. a plurality of mini-chisels mounted on said second chisel receiving bed;
k. said main chisel having a flange and said plurality of mini-jacks being adapted to contact said flange to control the angle of tilt of said main chisel; and
l. a plurality of limit switches arranged to stop the penetration of said jack pressing said main chisel when said main chisel exceeds a predetermined angle of tilt.

3. A concrete breaker as set forth in claim 2 wherein said second chisel receiving bed has a projection thereon upon which said mini-chisels are mounted in a dovetail manner which permits said mini-chisels to slide linearly along said projection.

4. A concrete breaker as set forth in claim 3 wherein each mini-chisel has a concave portion on the rear surface thereof and wherein a spring is encased in said concave portion to hold said mini-chisels in position.

5. A concrete breaker as set forth in claim 4 wherein driving means for actuating said main chisel and said mini-chisels are encased in said other sub-frame.

6. A concrete breaker adapted to break a concrete structure by way of static compressive force comprising:

a. main frame having a substantially rectangular cross-section;
b. a pair of movable frames coupled by means of pins to opposite ends of said main frame;
c. a chisel mounted on each movable frame;
d. a jack for rotating said movable frames on said pins;
e. a chisel mounted on said main frame in such a manner that it is free to move along said main frame; and
f. means for moving said main frame with respect to said movable frames to cause the chisels mounted on said movable frames to force the concrete structure against the chisel mounted on said main frame.

7. A concrete breaker as set forth in claim 6 wherein said means for moving said main frame with respect to said movable frames comprises a plurality of jacks each of which is connected to said main frame and one of said movable frames.

8. A concrete breaker adapted to break a concrete structure by means of a static compressive force comprising:

a. a frame;
b. a jack mounted on said frame;
c. a chisel receiving bed provided at the end of said jack;
d. a chisel attached to said chisel receiving bed; and
e. means located on said chisel receiving bed for tilting the edge of said chisel out of alignment with the axis of said jack, said means including a plurality of mini-jacks.

9. A concrete breaker as set forth in claim 8 wherein said means for tilting said chisel includes a socket joint attaching said chisel to said chisel receiving bed.

* * * * *